US009604183B2

(12) United States Patent
Dinnison

(10) Patent No.: US 9,604,183 B2
(45) Date of Patent: Mar. 28, 2017

(54) FOLDING MIXING IMPELLER

(71) Applicant: Jay G. Dinnison, Seattle, WA (US)

(72) Inventor: Jay G. Dinnison, Seattle, WA (US)

( * ) Notice: Subject to any disclaimer, the term of this patent is extended or adjusted under 35 U.S.C. 154(b) by 134 days.

(21) Appl. No.: 14/588,415

(22) Filed: Jan. 1, 2015

(65) Prior Publication Data

US 2016/0193575 A1 Jul. 7, 2016

(51) Int. Cl.
*B01F 7/00* (2006.01)

(52) U.S. Cl.
CPC ..... *B01F 7/00058* (2013.01); *B01F 7/00341* (2013.01)

(58) Field of Classification Search
CPC ..... B01F 7/0066
USPC ..... 366/308; 416/142
See application file for complete search history.

(56) References Cited

U.S. PATENT DOCUMENTS 3,455,540 A * 7/1969 Marcmann ..... B01F 7/00066 366/129
3,559,962 A * 2/1971 Enssle ..... B01F 7/00066 366/308
4,083,653 A * 4/1978 Stiffler ..... B01F 7/00066 366/308
5,941,636 A * 8/1999 Lu ..... B01F 7/00066 366/249

* cited by examiner

*Primary Examiner* — David Sorkin
(74) *Attorney, Agent, or Firm* — Charles J. Rupnick, Attorney at Law

(57) ABSTRACT

A folding impeller formed around a central hub. The folding impeller has a plurality of impeller blades each formed with a leading portion that is extended from a trailing portion, with the leading and trailing portions of the blade and including an obtuse angle therebetween. The trailing portion of each blade is mounted for tangential rotation about the hub between a folded state and a spread state, wherein in the folded state an axis of the hub lies within the angle included between the leading and trailing portions of each of the impeller blades, and wherein in the spread state each blades is tangentially extended from the hub with the included angle being arranged transverse of the axis of the hub, and wherein the trailing portion is arranged substantially parallel with the axis, and the leading portion forms an angle of attack therewith.

20 Claims, 10 Drawing Sheets

Fig. 1
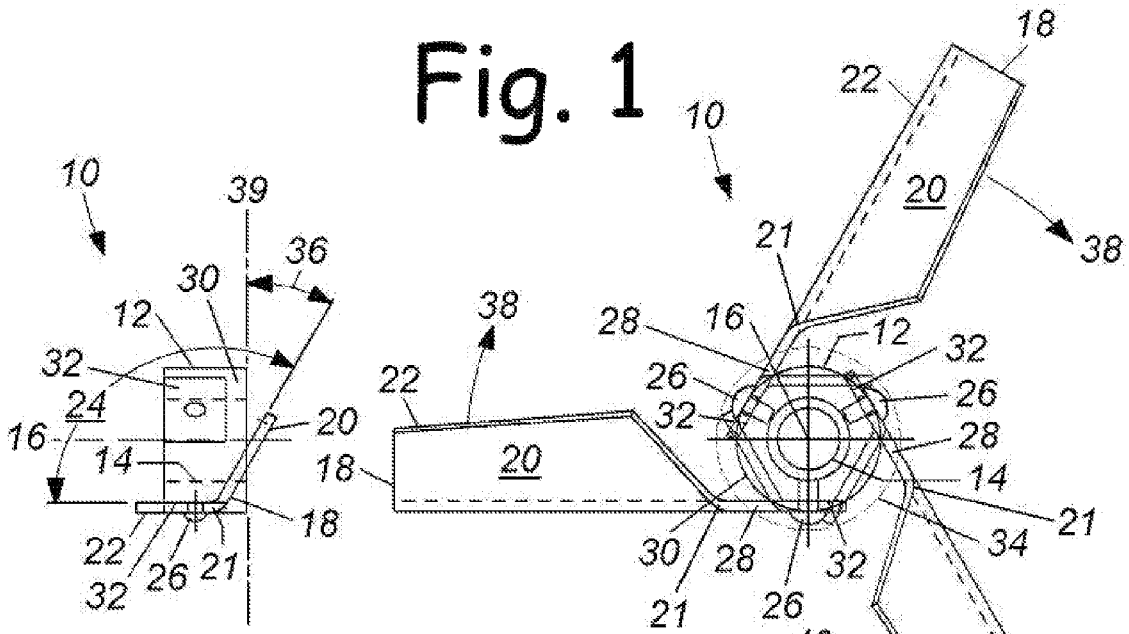
Fig. 3
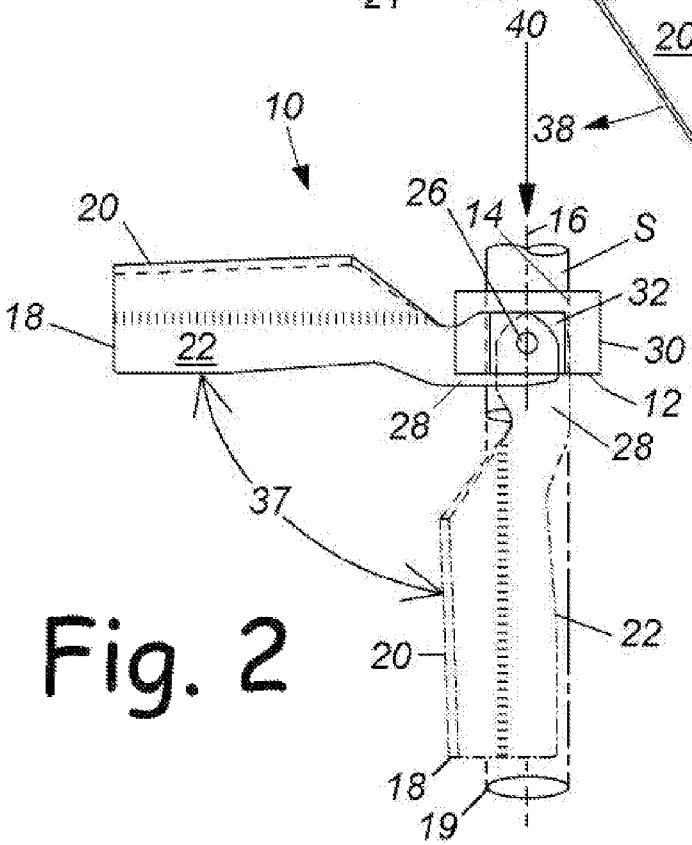
Fig. 2

FOLDING MIXING IMPELLER

FIELD OF THE INVENTION

The present invention relates generally to mixing impellers, and in particular to mixing impellers which are rotated by a motor-driven drive shaft for mixing a liquid material and being structured to fold about the motor-driven drive shaft for installation into and removal from a closed mixing vessel.

BACKGROUND OF THE INVENTION

Mixing impellers are in wide use in industry. Examples of industrial mixing impellers include designs which have a central hub and two, three, four or more radially extending blade type structures. These blades may be flat, angled, and in some cases have a wing or propeller shape. Typically, the impellers extend radially outwardly from a motor-driven shaft and are submerged inside a material to be mixed. Oftentimes the impellers are in an at least partially liquid mix which is being confined in a vessel, which may be holding the material in a batch process or a continuous process.

Some mixing vessels are closed, and the impeller is moved into and out of the vessel through a small opening by folded the blades of the impeller around the drive shaft. Impellers having folding blades are known for being mounted at the end of the drive shaft. However, known designs for impellers having such folding blades tend to be for small impellers, and such known designs for small folding blade impellers tend to be inefficient and unsophisticated, and require a large opening to pass into and out of the closed vessel.

SUMMARY OF THE INVENTION

Some aspects of some embodiments of the invention provide a mixing impeller that can mitigate, at least to some extent, the effect of the development of "rags" or other collections adhering to the leading edge of the impeller, or to any edge of the impeller.

Accordingly, the present invention is a folding impeller formed around a central hub that has a cylindrical bore defining a center axis and a mechanism for rotationally and translationally fixing the impeller on an appropriate drive shaft. The folding impeller includes a plurality of impeller blades each being formed with a leading portion that is extended from a trailing portion, with the leading and trailing portions of the blade and forming an obtuse angle included therebetween. The trailing portion of each impeller blade is rotatably mounted for tangential rotation about the central hub between a folded state and a spread state, wherein in the folded state the axis of the hub lies within the angle included between the leading portion and the trailing portion of each of the impeller blades, and wherein in the spread state each of the impeller blades is tangentially extended from the center hub with the angle included between the leading portion and the trailing portion being arranged transverse of the axis of the hub, and wherein the trailing portion is arranged substantially parallel with the axis, and the leading portion is arranged an angle therewith.

According to another aspect of the invention, the blade design of the folding impeller is more efficient than known prior art designs. An angle of attack of the folding blades of the impeller is shallower or flatter and less perpendicular, to the center axis. Accordingly, the leading edge portion of each folding blade is more parallel to the axis and to the flow of the material in the vessel. The trailing edge portion of each blade is a steeper pitch relative to the center axis than known prior art devices. Therefore, the trailing edge portion of each blade is more perpendicular to the flow direction, which causes the flow to accelerate in the flow direction. This shallower or flatter and less perpendicular design of the leading edge portion, and the steeper pitched trailing edge portion of folding the blades is exactly opposite from the less sophisticated impellers of the prior art that fold the blade oppositely to fit around the drive shaft.

According to another aspect of the invention, the blade design of the folding impeller is a forward pitch blade design that actually folds the blades into the flow of the material in the vessel when the folding impeller is opening. Thus, this forward pitch blade of the folding impeller is a design that actually folds toward the flow direction in the vessel when opening the folding impeller is unfolding from the folded state into the spread state. Furthermore, this novel forward pitch design of the folding impeller permits the blades to be formed such that each blade wraps around the drive shaft when the impeller is folded, while providing an efficient blade design for operating in the mixing vessel. This action of the folding impeller of opening into the flow of the material is counter-intuitive, at least given the prior art designs, but centrifugal force generated by the drive shaft starts the unfolding movement of the impeller, and the blade pitch (the angle of attack) catches the flow and completes the opening action.

According to another aspect of the invention, the folding impeller has three impeller blades that are uniformly distributed around the central hub, which ensures balanced operation when the drive shaft is turning.

According to another aspect of the invention, the central hub of the folding impeller is formed with a cylindrical bore completely there through, which permits the impeller to be mounted anywhere on the drive shaft. In contrast, known folding impellers of the prior art only have socket-style hubs such that the impeller can only be mounted on the end of the drive shaft.

According to another aspect of the invention, the blades hang under gravity along the drive shaft when the folding impeller is in the folded state, which permits the pass-through opening in the mixing vessel to be smaller for inserting and removing the impeller than was possible for prior art impeller devices. Other folding impeller designs of the prior art hang the blades offset from the hub, and actually require the user to hold the blades together around the drive shaft when inserting the impeller into the vessel opening.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 is a plan view drawing showing an example of the folding mixing impeller of the invention for mounting on a drive shaft;

FIG. 2 is a side view drawing showing the folding impeller of FIG. 1 in each of a folded state (phantom lines) and a spread state (solid lines);

FIG. 3 is an end view drawing of the folding impeller of FIG. 1;

DETAILED DESCRIPTION OF PREFERRED EMBODIMENT

Figure 4:
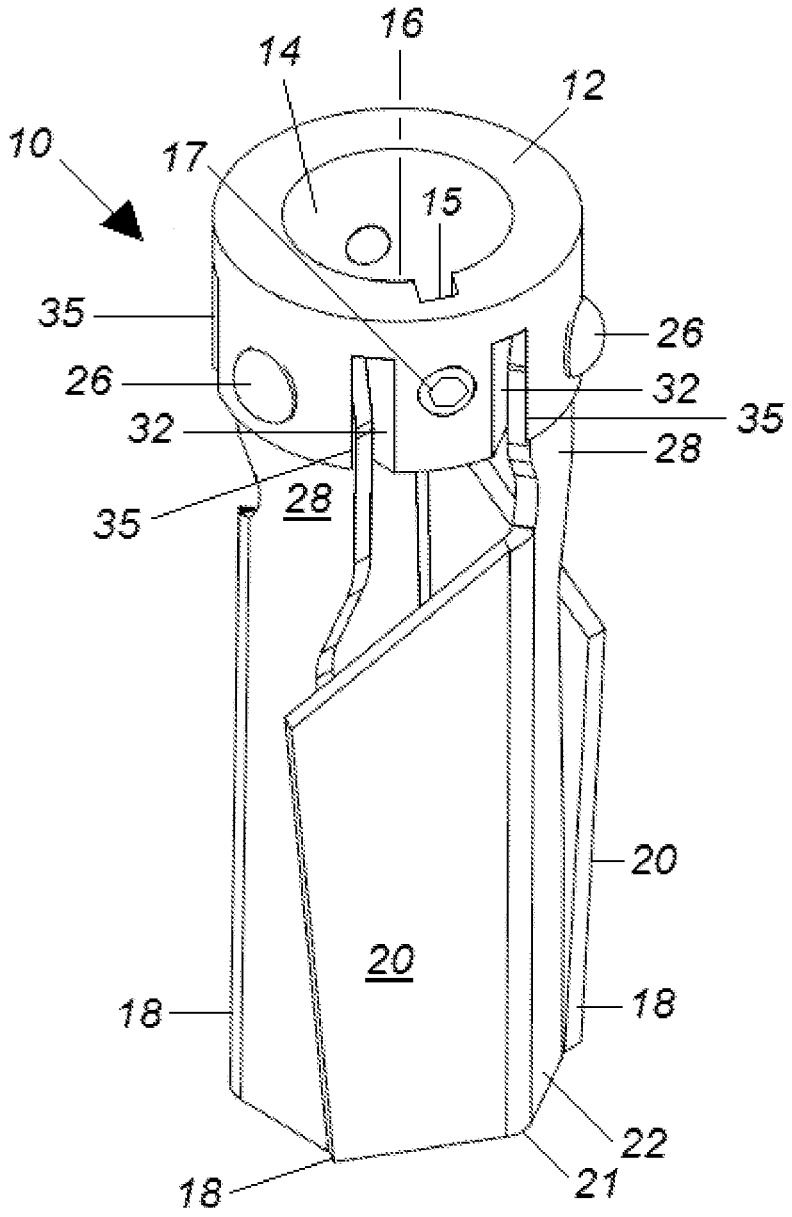
FIG. 4 is a photograph of an example of the folding impeller of FIG. 1 shown collapsed into the folded state.
Figure 5:
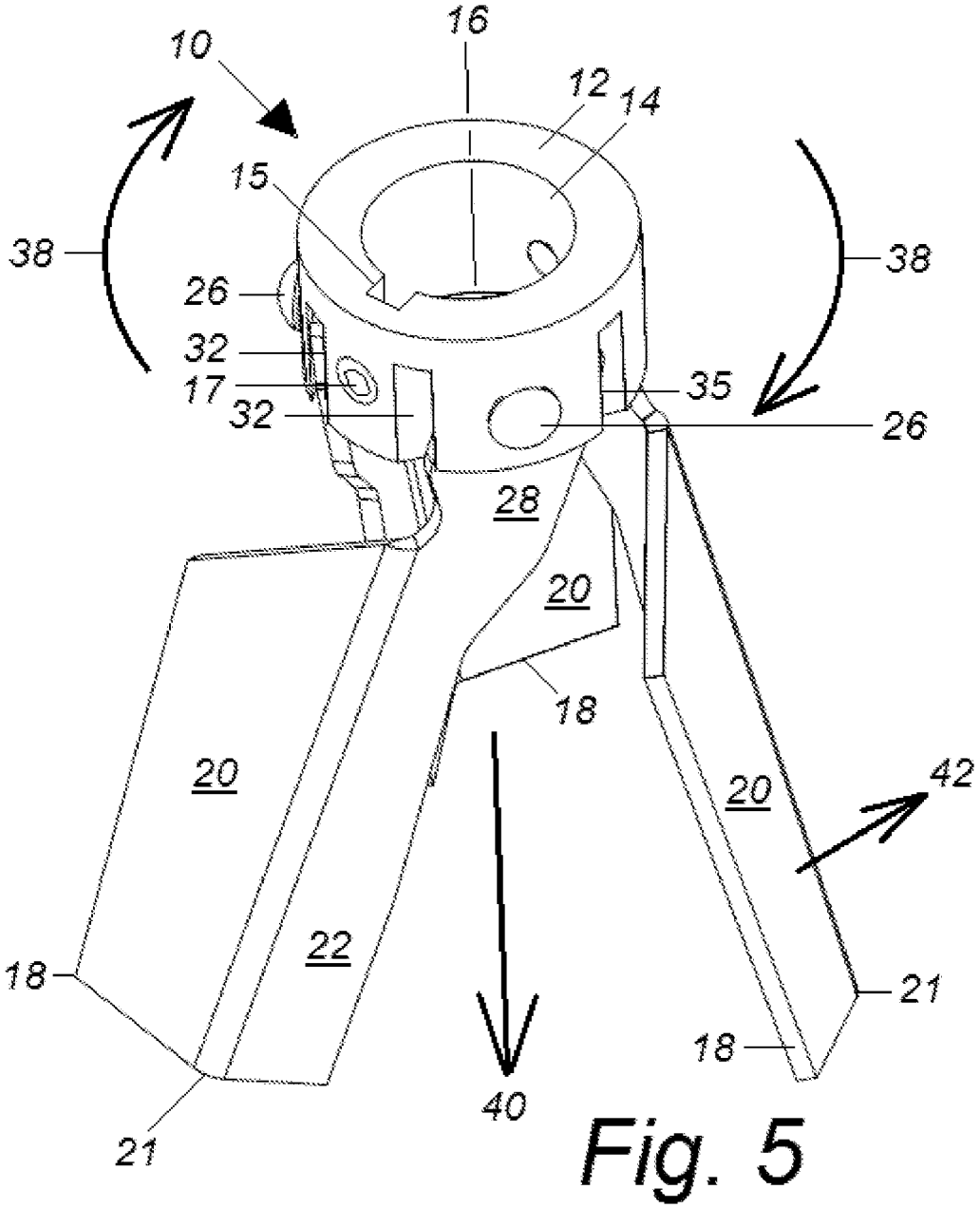
FIG. 5 is a photograph of the example of the folding impeller of FIG. 1 shown beginning to open from the collapsed folded state outwardly toward the spread state.
Figure 6:
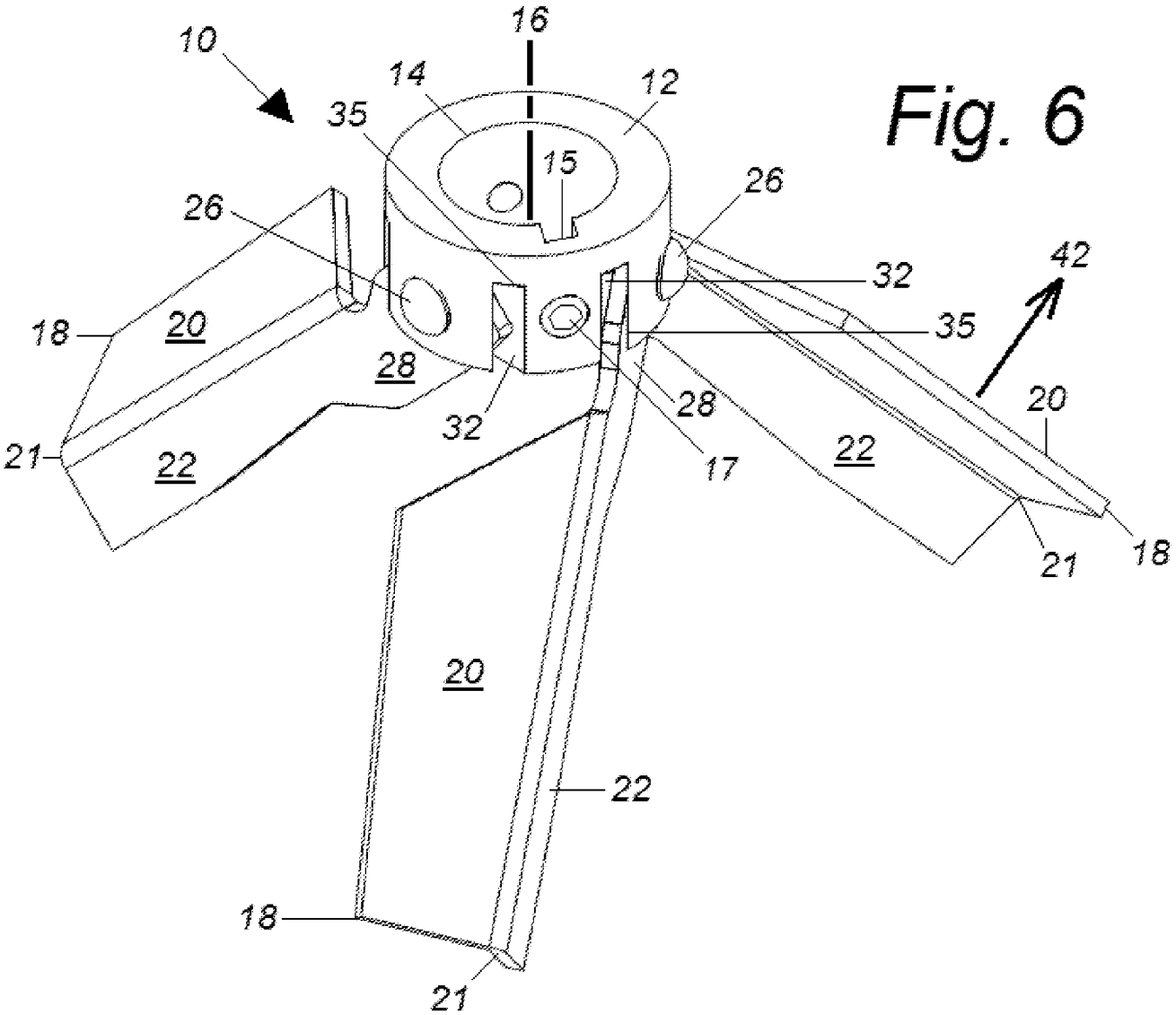
FIG. 6 is a photograph of the example of the folding impeller of FIG. 1 shown in the course of opening from the collapsed folded state outwardly toward the spread state.
Figure 7:
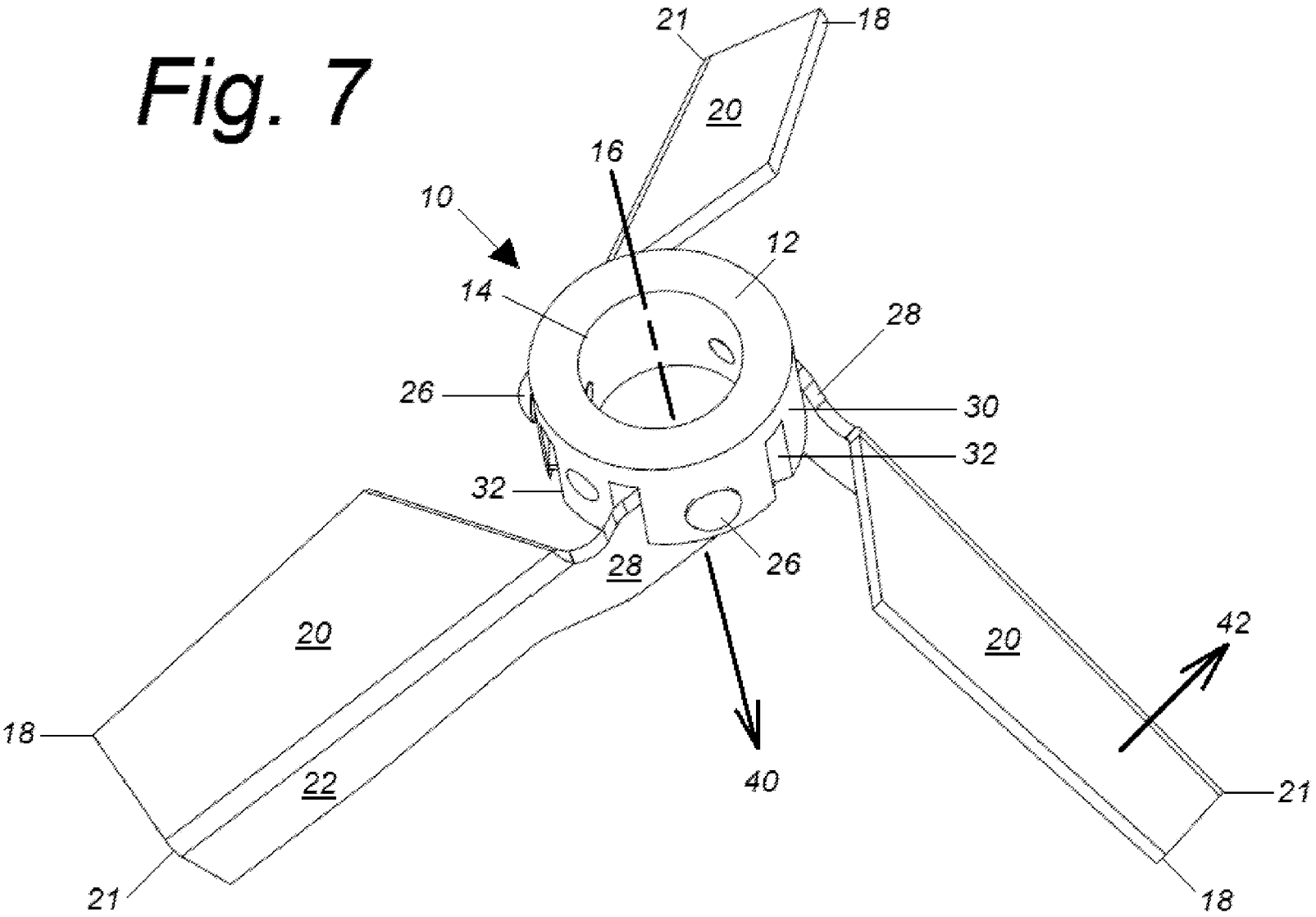
FIG. 7 is a photograph of the example of the folding impeller of FIG. 1 shown yet further expanded over the view shown in FIG. 6 during the course of opening from the collapsed folded state outwardly toward the spread state.
Figure 8:
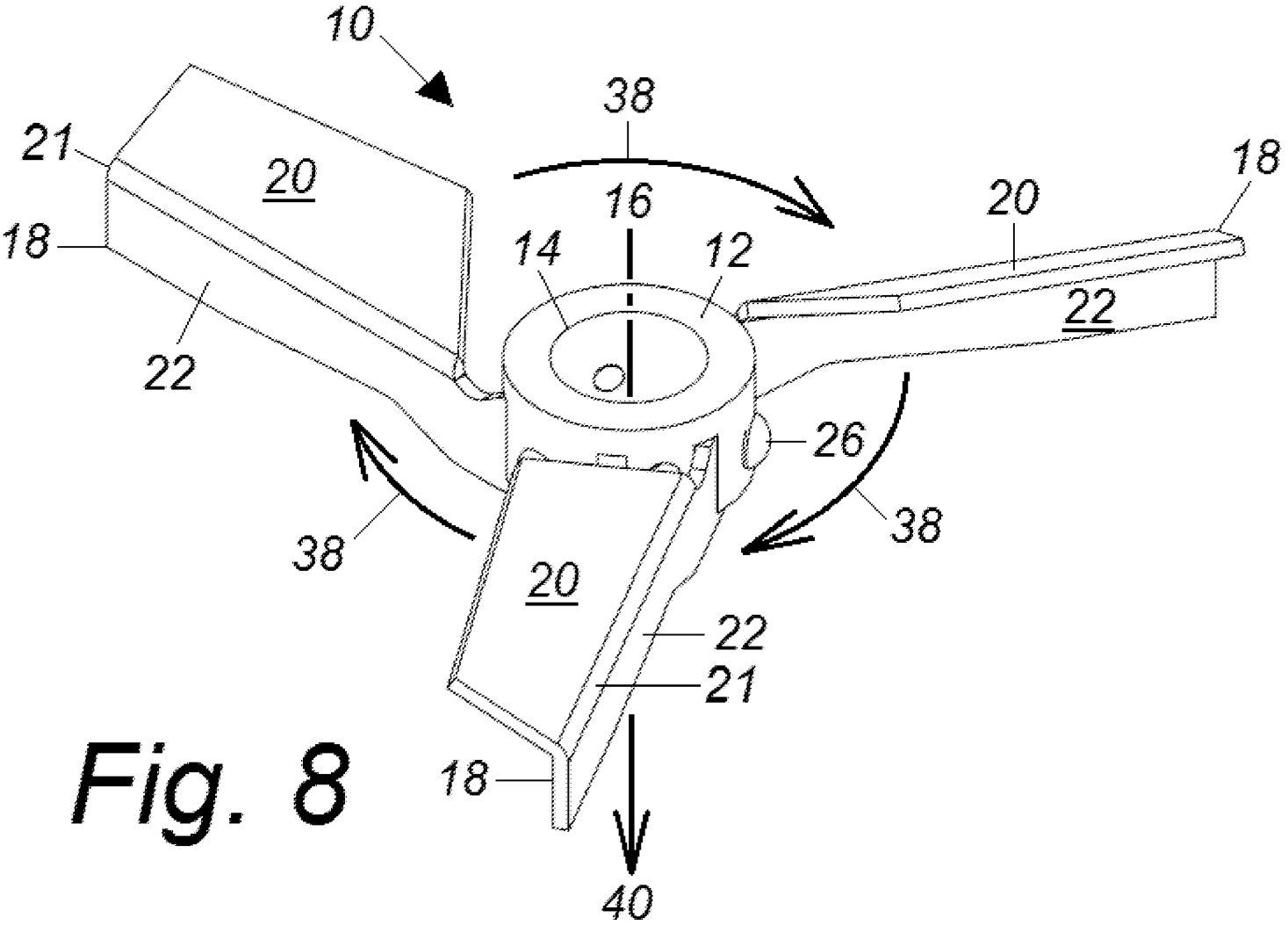
FIG. 8 is a top photograph of the example of the folding impeller of FIG. 1 shown substantially expanded into the spread state.
Figure 9:
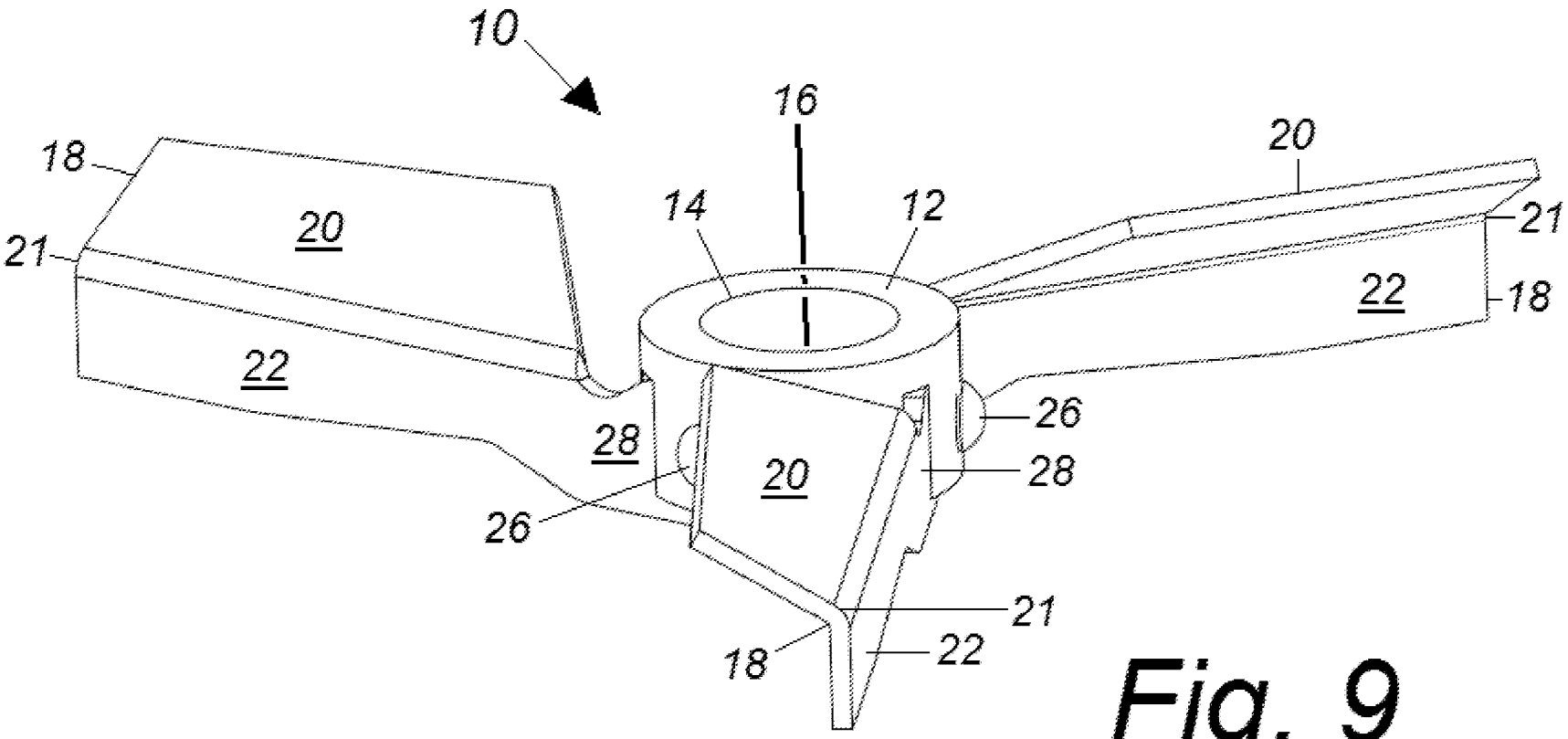
FIG. 9 is a side perspective view photograph of the example of the folding impeller of FIG. 1 shown substantially expanded into the spread state.
Figure 10:
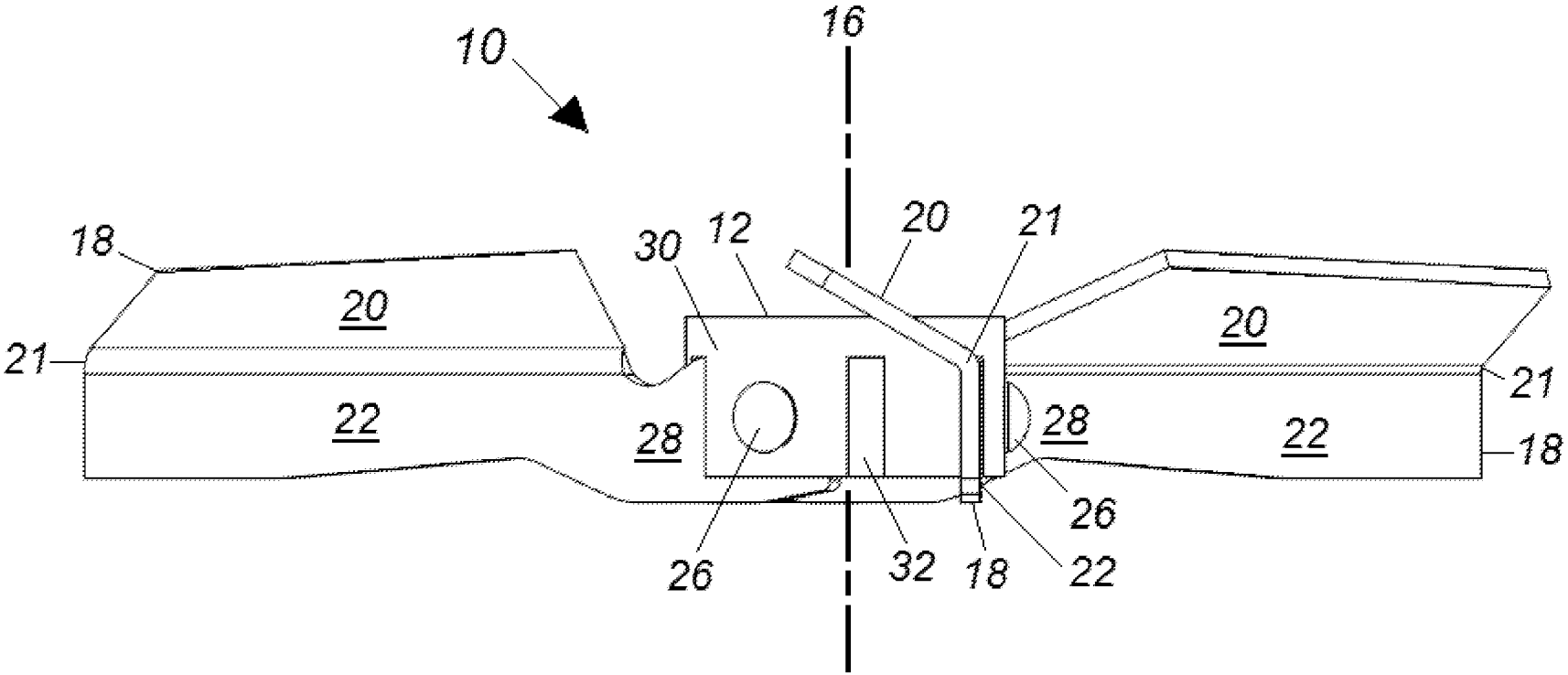
FIG. 10 is a side view photograph of the example of the folding impeller of FIG. 1 shown substantially expanded into the spread state.
Figure 11:
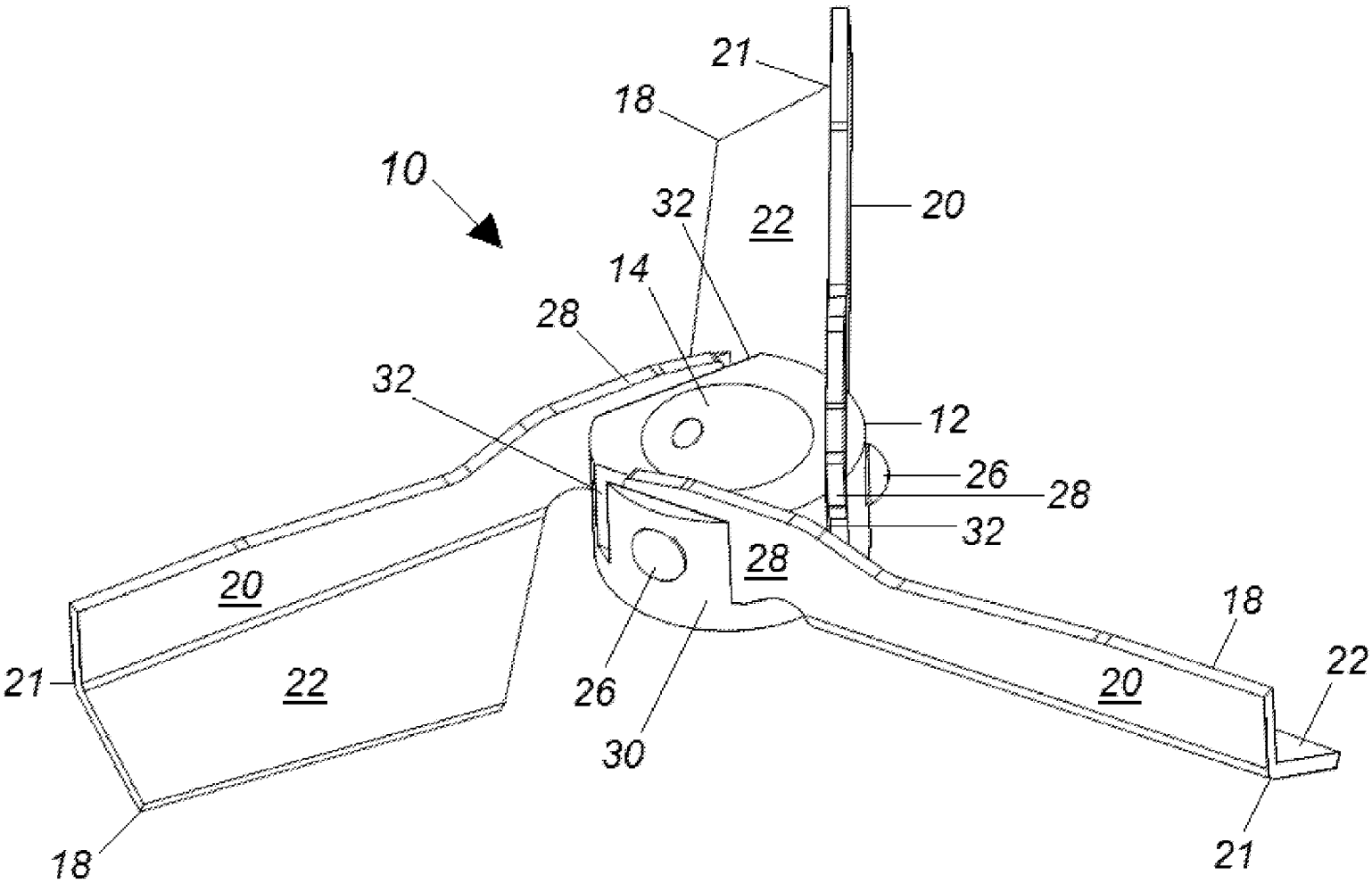
FIG. 11 is a bottom perspective view photograph of the example of the folding impeller of FIG. 1 shown substantially expanded into the spread state.
Figure 12:
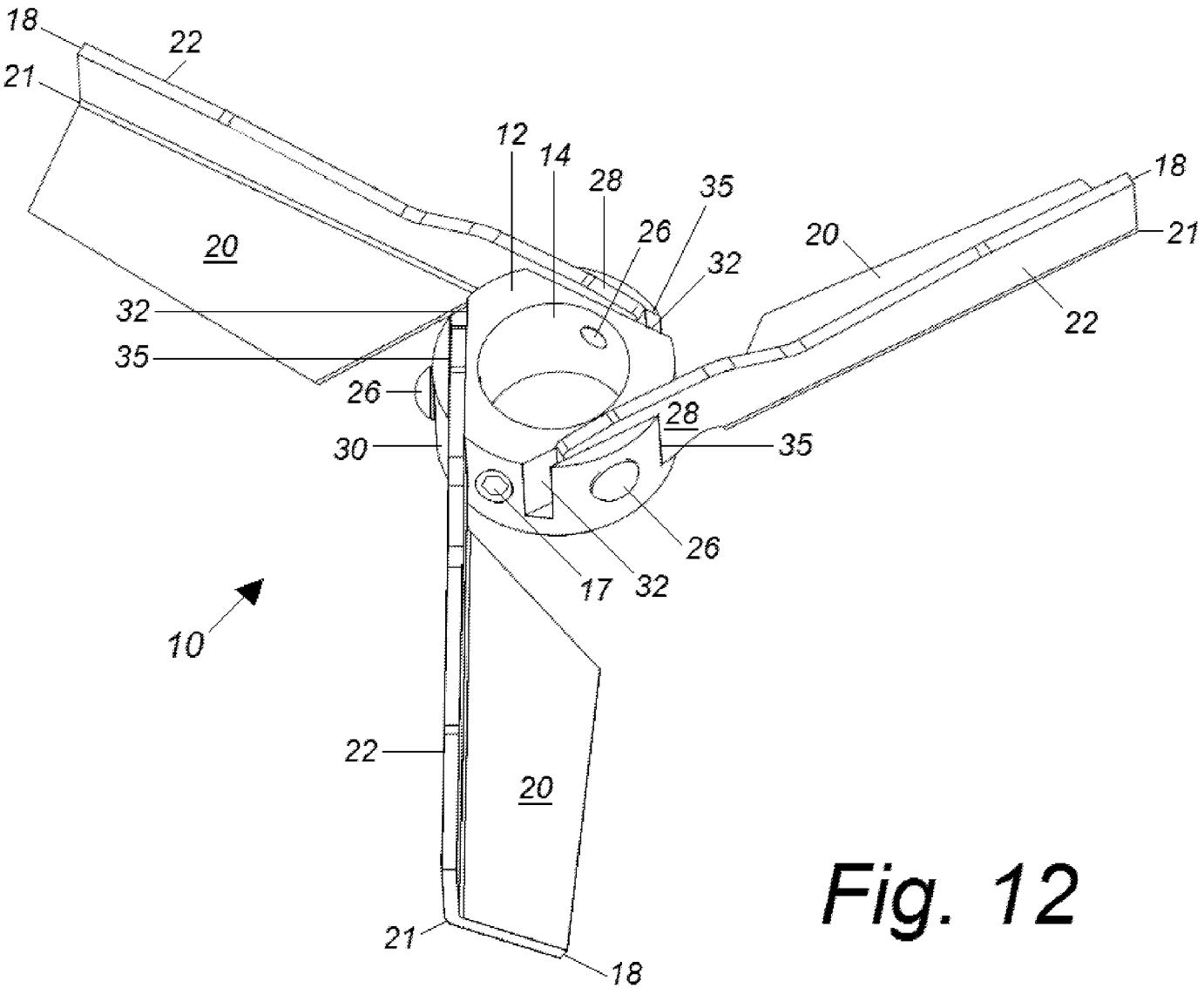
FIG. 12 is another bottom perspective view photograph of the example of the folding impeller of FIG. 1 shown substantially expanded into the spread state and rotated from the view shown in FIG. 11.

A detailed illustrative embodiment of the present mixing impeller device is disclosed herein. However, techniques, systems and operating structures in accordance with the present mixing impeller device may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present mixing impeller device. The following presents a detailed description of an illustrative embodiment of the present mixing impeller device.

In the Figures, like numerals indicate like elements.

FIGS. 1, 2 and 3 are plan, side and end views, respectively, of an example of a folding impeller 10 of the invention for mounting on a drive shaft S. Typically drive shaft S extends all the way through impeller 10, or impeller 10 can be mounted at the end of drive shaft S. Typically, drive shaft S extends inside a vessel (not shown) containing the material to be mixed, and is driven by a motor outside the vessel. For example, impeller 10 is formed around a central hub 12 having a cylindrical bore 14 therethrough defining a longitudinal axis of rotation 16. Cylindrical bore 14 optionally is formed with a keyed slot 15 for rotationally fixing impeller 10 on drive shaft S. Alternatively, a set screw or other mechanism 17 is provided for rotationally fixing impeller 10 on drive shaft S. The same or another mechanism also translationally fixes impeller 10 along the length of drive shaft S.

Folding impeller 10 includes a plurality (three shown) of impeller blades 18 uniformly distributed around central hub 12 in such manner as to ensure balanced operation when drive shaft S is turning. Each impeller blade 18 has a leading edge portion 20 extended along a bend 21 thereof from a trailing edge portion 22 and forming an obtuse angle 24 included therebetween. As shown in FIG. 2, trailing portion 22 of each impeller blade 18 is rotatably mounted for tangential rotation about central hub 12 between a folded state (phantom lines) and a spread state (solid lines). For example, a pin or other hinge member 26 rotatably couples a proximal end portion 28 of each impeller blade 18 to an exterior wall 30 of hub 12 for tangential rotation between the folded state (phantom lines) and the spread state (solid lines). According to one embodiment, exterior wall 30 of hub 12 is formed with a series of flats 32 uniformly distributed thereabout. Each impeller blade 18 is rotatably mounted on one of flats 32 by hinge member 26. Flats 32 permit impeller blades 18 to operate in a more balanced manner by providing a stable base for impeller proximal end portions 28.

Folding mixing impeller 10 is collapsible into it's folded state (phantom lines) about hub 12 to a size small enough to fit through an opening into a closed vat. Flats 32 also permit impeller blades 18 collapse within a smaller footprint 34 (shown in dashed lines) than would result without flats 32 being present. For example, in FIG. 4 flats 32 are shown as interior walls of a plurality of slots 35 formed partially through exterior wall 30 of hub 12.

Accordingly, proximal end portion 28 of each trailing portion 22 of each impeller blade 18 is rotatably mounted by hinge member 26 to one of flats 32 on exterior wall 30 of central hub 12 for tangential rotation thereabout.

In FIG. 2 impeller 10 is shown in each of the folded state (phantom lines) and spread state (solid lines). In the folded state (phantom lines) of impeller 10, longitudinal axis 16 of center hub 12 lies within included angle 24 between leading portion 20 and trailing portion 22 of each of impeller blades 18, whereby impeller blades 18 are aligned substantially along drive shaft S. Accordingly, folded impeller 10 can be moved into and out of a closed vessel (not shown) through a small opening no larger than footprint 34 defined by folded impeller blades 18.

Impeller blades 18 are rotated (arrow 37) about hinge members 26 for being tangentially extended from respective flats 32 on exterior wall 30 of center hub 12. In the spread state (solid lines) of impeller 10, angle 24 included between leading portion 20 and trailing portion 22 of each impeller blade 18 is arranged substantially transverse of axis 16 of center hub 12. Accordingly, trailing portion 22 of each impeller blade 18 is arranged substantially parallel with axis 16, and leading portion 20 is arranged at an angle-of-attack 36 from the perpendicular thereto when impeller 10 rotates in a direction (arrows 38) according to drive shaft S and positive relative to a plane of rotation 39 through which impeller hub 12 rotates on drive shaft S, as illustrated in FIG. 3.

Folding impeller 10 is a design aimed at smaller sizes, e.g., less than twenty (20) inch diameter, but the design could be expanded upwards from there as well without undue experimentation.

One unique feature of folding impeller 10 is a blade design that is more efficient than known prior art designs. Angle of attack 36 of folding blades 18 of impeller 10 is shallower or flatter and less perpendicular, to axis 16. Accordingly, leading edge portion 20 of each folding blade 18 is more parallel to axis 16 and to the flow (arrow 40) of the material in the vessel. Trailing edge portion 22 of each blade 18 is a steeper pitch relative to axis 16 than known prior art devices. Therefore, trailing edge portion 22 of each blade 18 is more perpendicular to the flow direction, which causes the flow to accelerate in the flow direction. This shallower or flatter and less perpendicular design of leading edge portion 20, and steeper pitched trailing edge portion 22 of folding blades 18 is exactly opposite from the less sophisticated impellers of the prior art that fold the blade oppositely to fit around the drive shaft S.

Another unique feature of folding impeller 10 is a forward pitch blade design that actually folds blades 18 into the flow of the material in the vessel when folding impeller 10 is opening. Thus, this forward pitch blade 18 of folding impeller 10 is a design that actually folds toward the flow direction in the vessel when opening folding impeller 10 is unfolding from the folded state into the spread state. Furthermore, as illustrated in FIG. 3, this novel forward pitch design of folding impeller 10 permits blades 18 to be formed such that each blade 18 wraps around drive shaft S, or around a columnar space 19 defined either by an extension of cylindrical bore 14 through central hub 12 or by an extension of drive shaft S, when impeller 10 is folded, while providing an efficient blade design for operating in the mixing vessel. This action of folding impeller 10 of opening or unfolding into the flow of the material is counter-intuitive, at least as taught by the prior art designs, but centrifugal force generated by drive shaft S starts the unfolding movement of impeller 10, and the blade pitch (attack angle 36) catches the flow and completes the opening action.

Most known folding impellers of the prior art only have two blades, which causes the impellers to be both less efficient and less stable in operation, than the three impeller blades 18 of folding impeller 10 that are uniformly distributed around central hub 12, which ensures balanced operation when drive shaft S is turning.

Central hub 12 of folding impeller 10 is formed with cylindrical bore 14 completely there through, which permits impeller 10 to be mounted anywhere on drive shaft S. In contrast, known folding impellers of the prior art only have socket-style hubs such that the impeller can only be mounted on the end of drive shaft S.

Also, blades 18 of folding impeller 10 hang along drive shaft S when in the folded state, which permits the pass-through opening in the vessel to be smaller for inserting and removing impeller 10 than was possible for prior art impeller devices. Other folding impeller designs of the prior art hang the blades offset from the hub, and actually require the user to hold the blades together around drive shaft S when inserting the impeller into the vessel opening.

FIGS. 4-12 are different photographs of the example of the folding impeller 10 of FIGS. 1-3 shown in various stages of unfolding (arrows 42) between the folded state and the spread state (or folding between the spread state and the folded state).

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A folding impeller, comprising:

a central hub having an axis of rotation defined along a cylindrical bore;

a plurality of impeller blades each comprising a leading portion extended from a trailing portion and forming an obtuse angle included therebetween, the trailing portion of each impeller blade being rotatably mounted for tangential rotation about the central hub between a folded state and a spread state, wherein in the folded state of the impeller blades, the axis of the center hub lies substantially within the included angle of each of the impeller blades, and wherein in the spread state of the impeller blades, each of the impeller blades is tangentially extended from the center hub with the included angle being arranged transverse of the axis of the center hub, and wherein the trailing portion is arranged substantially aligned with the axis, and the leading portion is arranged an angle therewith.

2. The folding impeller of claim 1, wherein in the spread state of the impeller blades, the angle included between the leading portion and the trailing portion is arranged substantially perpendicular to the axis of rotation of the center hub.

3. The folding impeller of claim 1, wherein the trailing portion is arranged substantially parallel with the axis of rotation.

4. The folding impeller of claim 1, wherein the angle included between the leading portion and the trailing portion is an obtuse angle.

5. The folding impeller of claim 4, wherein in the spread state of the impeller blades, the leading portion of each of the impeller blades is arranged at an attack angle from the perpendicular thereto when the impeller rotates about the axis of rotation.

6. The folding impeller of claim 1, wherein a hinge member rotatably couples each impeller blade for tangential rotation about the central hub.

7. The folding impeller of claim 6, wherein the hinge member further comprises a pin rotatably coupling the trailing portion of each impeller blade to an exterior wall of the hub.

8. A folding impeller, comprising:

a central hub comprising an exterior wall surrounding a cylindrical bore defining a longitudinal axis of rotation;

a plurality of impeller blades each comprising a leading portion extended from a trailing portion and defining an obtuse angle included therebetween, the trailing portion of each impeller blade being pinned at the exterior wall of the central hub in a manner permitting tangential rotation thereof between a folded state and a spread state, wherein in the folded state of the impeller blades, the longitudinal axis of the central hub is substantially aligned with the angle included between the leading portion and the trailing portion of each of the impeller blades, and wherein in the spread state of the impeller blades, each of the impeller blades is tangentially extended from the exterior wall of the central hub with the angle included between the leading portion and the trailing portion being arranged transverse of the longitudinal axis of the central hub, and wherein the trailing portion is arranged substantially aligned with the longitudinal axis, and the leading portion forming a angle of attack that is positive relative to a plane of rotation of the central hub.

9. The folding impeller of claim 8, wherein a hinge member rotatably pins each impeller blade for tangential rotation relative to the exterior wall of the central hub.

10. The folding impeller of claim 9, wherein the hinge member further comprises a pin rotatably coupling the trailing portion of each impeller blade to the exterior wall of the central hub.

11. The folding impeller of claim 8, wherein the exterior wall of the central hub further comprises a plurality of slots formed partially therethrough, and the trailing portion of each impeller blade is further rotatably mounted in one of the plurality of slots.

12. The folding impeller of claim 8, wherein the plurality of impeller blades is uniformly distributed around the exterior wall of the central hub.

13. The folding impeller of claim 12, wherein the plurality of impeller blades is three blades.

14. A folding impeller, comprising:

a central hub having an axis of rotation defined along a cylindrical bore;

a plurality of forward-pitch impeller blades each comprising a leading portion extended from a trailing portion and forming an obtuse angle included therebetween with the leading portion forming a forward pitch relative to a rotational direction of the central hub, the trailing portion of each impeller blade being rotatably mounted for tangential rotation about the central hub between a folded state and a spread state, wherein in the folded state of the forward-pitch impeller blades, the axis of rotation lies substantially within the included angle of each of the impeller blades, and wherein in the spread state of the forward-pitch impeller blades, each of the impeller blades is tangentially extended from the center hub with the included angle being arranged transverse of the axis of rotation, and wherein the trailing portion is arranged substantially aligned with the axis of rotation, and the leading portion is arranged for forming an angle-of-attack therewith.

15. The folding impeller of claim 14, wherein in the folded state of the forward-pitch impeller blades, the plurality of forward-pitch impeller blades fold around a columnar space defined by the cylindrical bore of the central hub.

16. The folding impeller of claim 15, wherein a hinge member rotatably pins the trailing portion of each impeller blade for tangential rotation relative to an exterior wall of the central hub.

17. The folding impeller of claim 16, wherein the exterior wall of the central hub further comprises a plurality of slots formed partially therethrough, and the trailing portion of each impeller blade is further rotatably mounted in one of the plurality of slots.

18. The folding impeller of claim 15, wherein the plurality of impeller blades is uniformly distributed around the central hub.

19. The folding impeller of claim 18, wherein the plurality of impeller blades is three blades.

20. The folding impeller of claim 18, wherein the cylindrical bore of the central hub is further mounted on a drive shaft;

wherein in the folded state the plurality of forward-pitch impeller blades fold around either the drive shaft, or around a columnar space defined either by an extension of the cylindrical bore of the central hub or by an extension of the drive shaft; and wherein the angle-of-attack of the leading portion is positive relative to a plane of rotation through which the central hub rotates on the drive shaft, and is further directed along a direction of rotation of the drive shaft.

* * * * *